United States Patent [19]

Usui et al.

[11] 4,161,912

[45] Jul. 24, 1979

[54] MINIATURE PRINTER

[75] Inventors: Kiyofumi Usui; Kozo Kodaira, both of Shiojiri, Japan

[73] Assignees: Shinshu Seiki Kabushiki Kaisha, Suwa; Kabushiki Kaisha Suwa Seikosha, Tokyo, both of Japan

[21] Appl. No.: 804,047

[22] Filed: Jun. 6, 1977

[30] Foreign Application Priority Data

Jun. 4, 1976 [JP] Japan ..... 51-65341

[51] Int. Cl.[2] ..... B41J 1/44

[52] U.S. Cl. ..... 101/99; 101/93.22; 101/101

[58] Field of Search ..... 101/93.07, 95, 93.22, 101/99, 101, 103, 110

[56] References Cited

U.S. PATENT DOCUMENTS

| | | | |
|---|---|---|---|
| 2,242,381 | 5/1941 | Aurbach | 101/93.07 |
| 3,690,249 | 9/1972 | Nihira et al. | 101/95 |
| 3,734,012 | 5/1973 | Huggins | 101/103 X |
| 3,756,147 | 9/1973 | Gross et al. | 101/110 X |
| 3,874,286 | 4/1975 | Ishikawa | 101/99 X |
| 3,884,144 | 5/1975 | Shimodaira | 101/99 |
| 3,967,550 | 7/1976 | Busch | 101/110 X |
| 4,033,756 | 7/1977 | Hanaoka | 101/99 |

*Primary Examiner*—Edward M. Coven

*Attorney, Agent, or Firm*—Blum, Moscovitz, Friedman & Kaplan

[57] ABSTRACT

A miniature printer especially suitable for use in a small calculator or the like, utilizes the energy released from a spring storage means to power the printing, paper feeding, and inking operations. The energy is stored by the spring from either manual operation or motor power.

19 Claims, 4 Drawing Figures

MINIATURE PRINTER

BACKGROUND OF THE INVENTION

This invention relates generally to a miniature printer and especially to a printer utilized in electronic table calculators, pocket calculators, and the like. In the art, such printers have generally required a constant input of energy to power the respective paper feeding, character selection, printing and inking functions. Such constant power requirements can cause a large drain on the small batteries generally utilized to power such devices. The instant invention is directed to a miniature printer utilizing energy storage means to power the respective functions without the need of constant energy input.

SUMMARY OF THE INVENTION

Generally speaking, a miniature printer especially suitable for use in small pocket calculators is provided. The printer utilizes the energy released from a spring storage means to power the printing, paper feeding, and inking operations. The energy is stored by the spring from either manual operation or motor power.

Accordingly, it is an object of this invention to provide an improved miniature printer of simple construction, lightweight, small size and low price.

Another object of the invention is to provide an improved miniature printer which is energy efficient.

Still another object of this invention is to provide a miniature printer which can store the energy input from manual operation or motor power and complete the printing cycle utilizing this stored energy.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
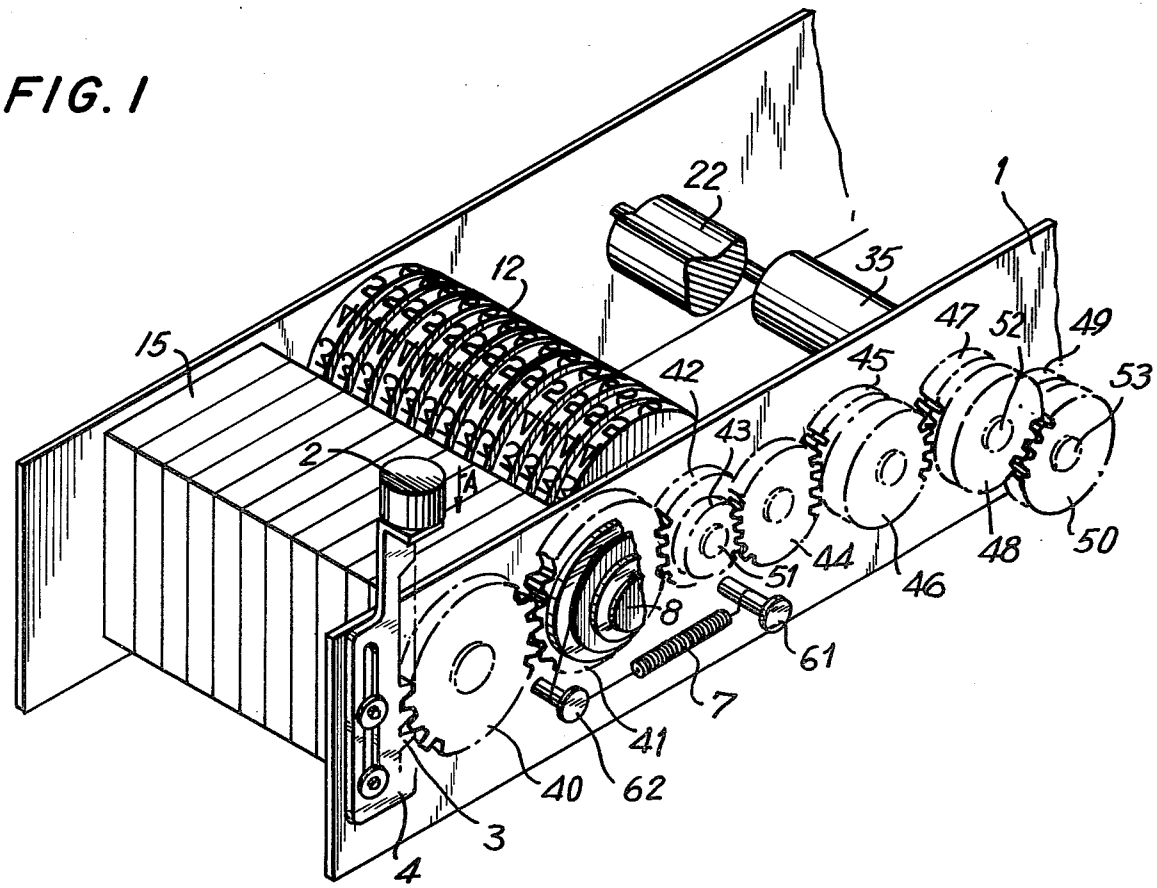
FIG. 1 is a perspective view of a miniature printer constructed in accordance with a preferred embodiment of the instant invention, with the pawl and the paper feeding mechanism removed, the printing cam partially cut away and certain gear teeth shown in phantom for the sake of clarity.
Figure 2:
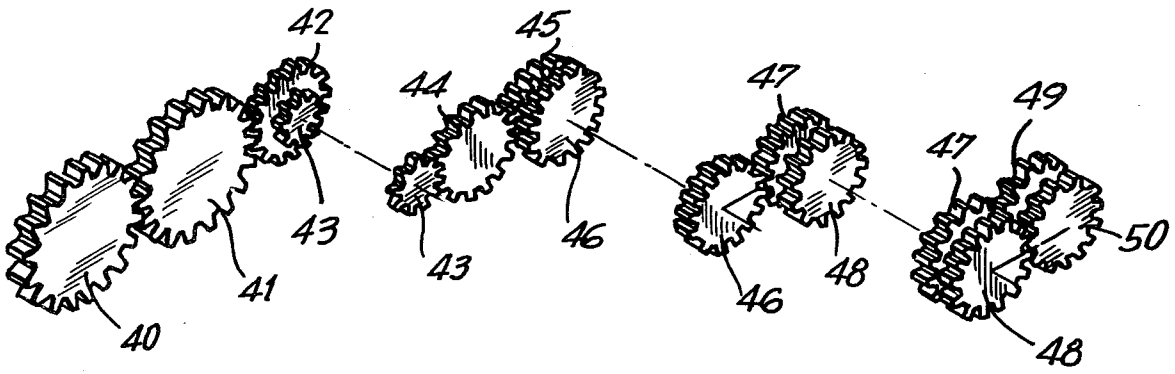
FIG. 2 is an exploded view of the gear train of the instant invention.

The drawings illustrate a miniature printer which includes a frame 1 which has a lever 4 slidably mounted to it and formed with a push button 2 and a rack portion 3. Rack portion 3 engages a circular gear 40 which is rotatably mounted to frame 1 which in turn engages a gear 41 which also is rotatably mounted to frame 1 and which includes a spiral groove portion 8. A coil spring member 7 has one end fixedly mounted by means of pin 61 to frame 1 and a second end which loops around a second pin 62 and is attached to spiral groove 8 of gear 41 for winding thereon. It should be noted that coil spring member 7 need not be wound on a spiral groove but may be wound on any other arrangement or on the teeth themselves.

Gear 41 in turn drives a gear 42 which is mounted coaxially with a gear 43 on a shaft 51 which is rotatably mounted to frame 1. The gear ratio between 41 and 42 is so arranged so that gear 42 will make two turns to every one turn of gear 41. Gear 43 which is driven with gear 42 in turn drives a gear 44 which makes one revolution for every two revolutions of gear 42. Gear 44 drives a gear 45 which in turn drives a coaxially mounted gear 46 through a one-way drive mechanism of conventional construction (not shown) so that gear 46 is only driven when gear 45 rotates in one direction and is not driven at all when gear 45 is driven in the opposite direction. Gear 46 is in engagement with a gear 47 which is coaxially mounted with a gear 48 on a shaft 52 which is rotatably mounted to frame 1. Gear 47 engages a gear 49 which is mounted coaxially with a gear 50 on a shaft 53, which is also rotatably mounted to frame 1. Gear 48 engages gear 50, gears 47 and 48 cooperating with gears 49 and 50 to index shaft 53 an incremental distance (angle of rotation) equal to a predetermined step.

Shaft 51, which is driven by gears 42 and 43, coaxially mounts a shaft 11 which carries a number of character rings 12 which are hereafter further described. Shaft 52 which is driven by gear 47 mounts a printing cam 22 which rotates along with gear 47. Shaft 53 mounts a paper feeding roller 45 which is rotated along with gears 49 and 50. The gear ratios between gears 47, 48, 49 and 50 are such that as gears 47 and 48, and consequently printing cam 22, complete one full revolution, gears 49, 50 and paper feeding roller 35 will be angularly displaced a distance corresponding to one line of type on paper 24.

The gear train of the miniature printer is arranged so that when push button 2 is displaced fully in direction A, gear 41 will make two full revolutions and will therefore wind spring 7 about groove 8. Gear 46 which is driven by a one-way drive mechanism with gear 45 will not rotate at all during the depression of gear 2 and thus all subsequent gears will not rotate. After push button 2 is released, spring member 7 will unwind along groove 8 and cause gear 41 to rotate in the opposite direction and will thus cause gear 45 to rotate in the opposite direction which will then rotate gear 46 and all subsequent gear train members.

Figure 3:
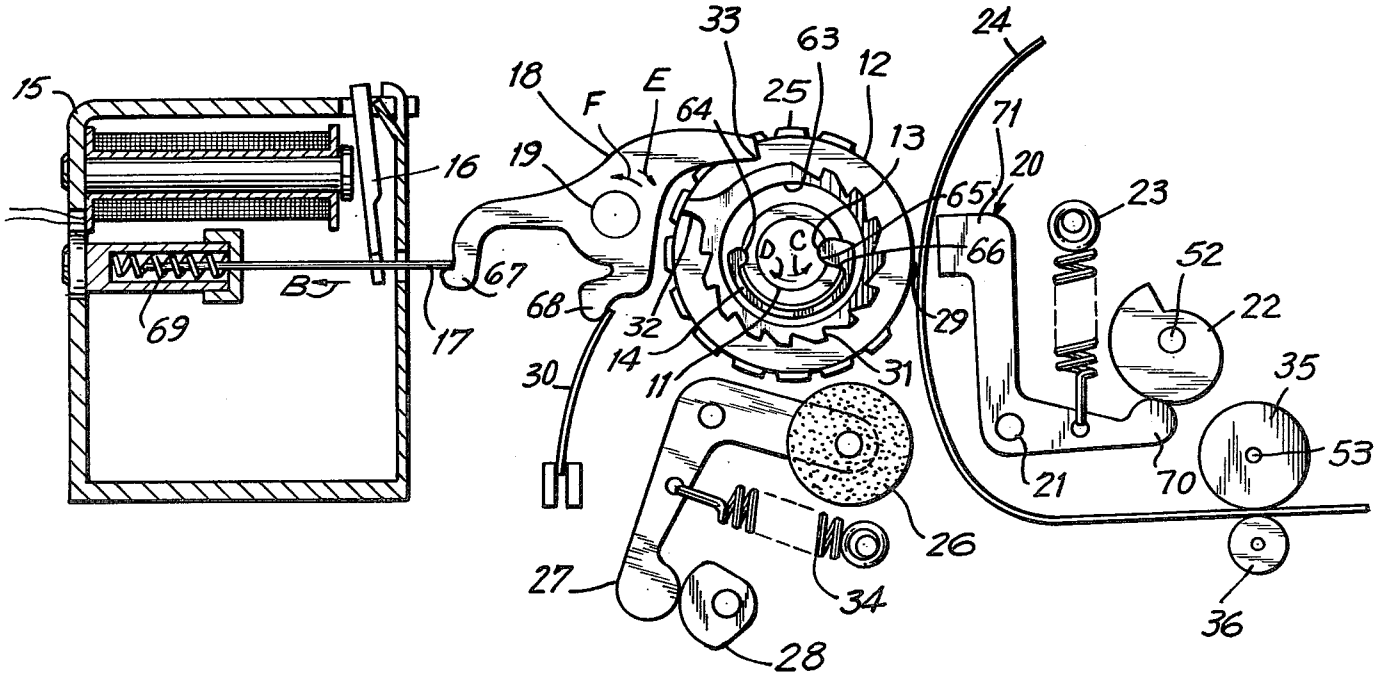
FIG. 3 is a side elevational view of the character selection, paper feeding, printing and inking mechanisms of the instant invention.

The printing actuation is best illustrated in FIG. 3. Shaft 11 which is driven by shaft 51 carries a plurality of character rings 12 each of which contains characters 25 disposed about their periphery. The operation of the selection mechanisms for each character ring is identical so that one description suffices as a description for all. Each character ring 12 is mounted to shaft 11 by means of a spring member 14 which rides in a recess 63 in character ring 12. Each spring member 14 is generally C-shaped in configuration and has a first end 64 fixedly mounted in recess 63 and a second end 65 which extends through an opening 66 in recess 63 to contact and ride in a groove 13 in the periphery of shaft 11.

Integral with character ring 12 is a ratchet wheel 31 which carries a number of serrated teeth corresponding to the number of characters 25 disposed on the periphery of character ring 12. The character selection is accomplished by means of a reciprocal pawl 18 which has an end 33 for engagement with the teeth of wheel 31. Pawl 18 is rotatably mounted to a shaft 19 which in turn is mounted to frame 1. Pawl 18 is initially positioned by means of trigger bar 17 which engages a notch in notched arm 67 of pawl 18. The cooperation of trigger bar 17 and notched arm 67 holds pawl 18 against the rotative bias in the direction of arrow E of leaf spring 30 which engages arm 68 of said pawl member. Trigger bar 17 includes an opening (not shown) through which a plate 16 extends. Plate 16 is pivotally mounted to electromagnet 15 which will attract plate 15 upon actuation which in turn will displace trigger bar 17 in direction B out of engagement with notched arm 67 of pawl 18. Trigger bar 17 is slidably reciprocal and is biased in the direction opposite direction B by means of a coil spring 69.

In operation, shaft 11 is rotatably driven in direction C by shaft 51 which in turn is driven by the gear train previously described. Character rings 12 are connected to shaft 11 and rotated therewith by means of spring 14. As each character ring 12 rotates, a sensing mechanism (not shown) detects its angular position in a conventional manner. When a character ring 12 is at the angular position corresponding to the desired character 25 the sensing mechanism will activate electromagnet 15 which will attract plate 16 which in turn displaces trigger bar 17 in direction B, which will cause pawl 18 to rotate in direction E and claw 33 of pawl 18 to engage the tooth of ratchet wheel 31 corresponding to the character desired. When claw 33 engages a tooth of ratchet wheel 31, the rotation of the selected character ring 12 will be stopped as spring member 14 will disengage from notch 13 in shaft 11, even though shaft 11 continues to rotate. Each character ring is stopped at the location of its desired character in a similar fashion and when all the character rings have been positioned the printing cycle can begin.

The paper web 24 to be printed upon is fed by means of paper feeding roller 35 and idler roller 36. Paper feeding roller 35 is mounted to and driven by shaft 53 which in turn is driven by gears 49 and 50. The impression of the characters 25 carried on character ring 12 upon paper web 24 is accomplished by print hammer 20 which is pivotally mounted to frame 1 by means of a shaft 21. Print hammer 20 has an extension 70 which is biased into engagement with printing cam 22 by means of a spring 23. As printing cam 22 is rotated by shaft 52, a second extension 71 of print hammer 20 will strike web 24 and the character 25 selected at a point 29 which will cause an impression of the character 25 on web 24. As cam 22 continues to rotate extension 71 of print hammer 20 will be displaced out of engagement with web 24.

After the printing stroke has been completed, the resetting and alignment of character rings 12 begins. This alignment takes place during the time when shaft 11 is driven in direction D by means of the gear train and the energy stored in spring member 7. As shaft 11 rotates in direction D, end 65 of spring member 14 will again engage groove 13 in shaft 11. As this occurs, character rings 12 will be rotated in direction D along with shaft 11. This rotation will continue until a stop tooth 32 extending from each ratchet wheel 31 engages claw 33 of the associated pawl 18. As each end 65 of spring member 14 is reengaged with groove 13 the state of alignment of the character rings 12 prior to that of the selection process is recovered. The form of groove 13 is designed so that it will not disengage spring member 14 as shaft 11 is rotated in direction D. Accordingly, as stop tooth 32 approaches and contacts claw 33 of pawl 18 it will displace pawl 18 in direction F against the force of springs 30 and 69 which will return pawl 18 to its preselection state out of engagement with the teeth of ratchet wheel 31. At this position, pawl 18 is once again held by trigger bar 17 engaging on the notch of notched arm 67.

After the return process is completed, shaft 11 and character rings 12 will continue to rotate in direction D so that the inking of characters 25 may be accomplished. An inking roller 26 is rotatably mounted to one end of a lever 27, the other end of which is biased into engagement with a rotating cam 28 by means of a spring 24. Cam 28 is synchronously driven by any suitable means (not shown) to interconnect with the gear means previously described. As cam 28 is rotated, inking roller 26 will be pressed into engagement with the characters 25 to transfer ink thereto during the second rotation of character rings 12 in direction D and thereafter out of such engagement.

Thus it is seen that the printing mechanism is so constructed that the selection process is carried out during one rotation of shaft 11 in direction C, the printing process is carried out during the stoppage of character rings 12, the return and alignment process of character rings 12 and pawls 18 occurs during the first rotation in direction D and the ink transferring process is carried out during the second rotation in direction D. For simplicity of description, shaft 11 has been described as though it made a complete 360° rotation in relation to character rings 12 and stop tooth 32, although it actually may not complete a full revolution in each direction.

Figure 4:
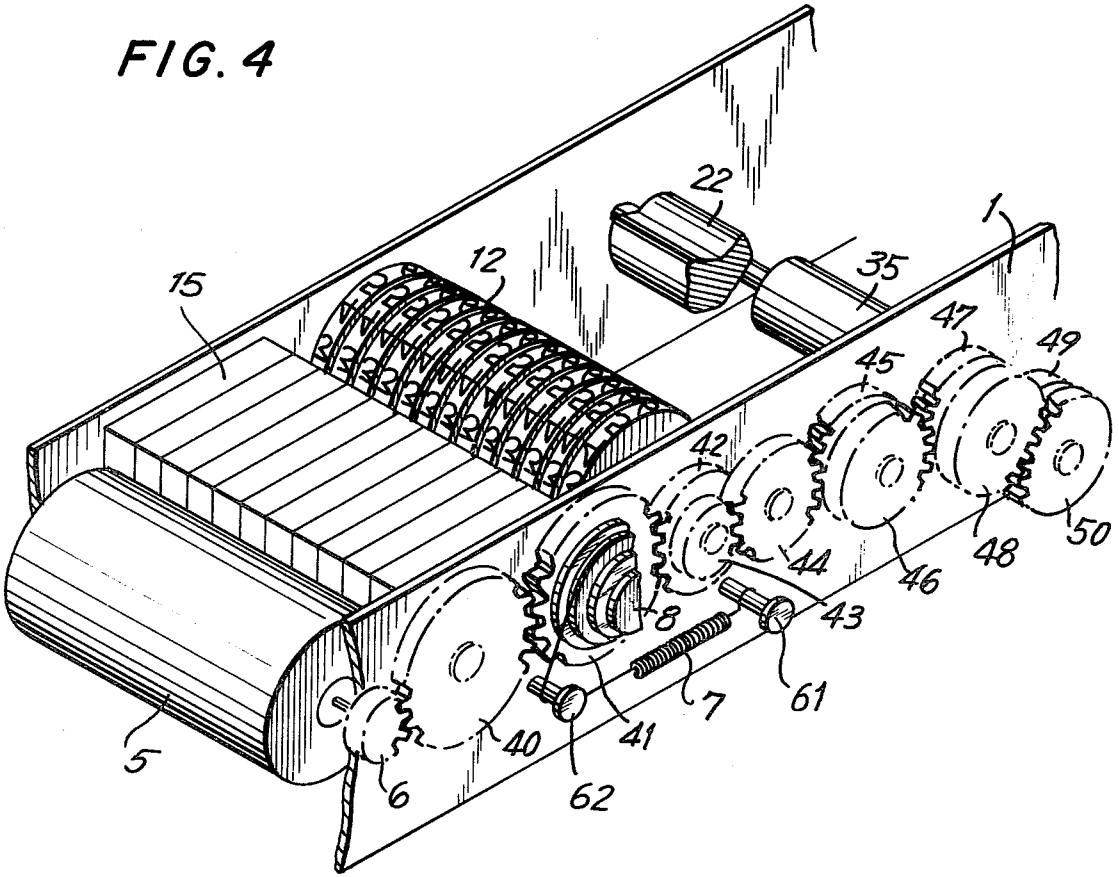
FIG. 4 is a perspective view, similar to that of FIG. 1, of another preferred embodiment of the instant invention.

FIG. 4 illustrates another preferred embodiment of the instant invention. In this embodiment, lever 4 and rack 3 are replaced by motor 5 and gear 6 respectively. All other details of construction remain the same, with like reference numerals referring to like structure. In this embodiment, spring 7 again acts as an energy storage means.

The use of an electric motor as the powering means for the printer allows for speed control of the various operation by means of the back-electromotive force of the motor. Rotation of the gear train by motor 5 and the storage and release of its energy by spring member 7, drives the printing and paper feeding cycles. When this stored mechanical energy is released, gear 6 will rotate the now electrically disconnected motor 5 which will then generate back-electromotive force. This back-electromotive force will act as a brake and cause the mechanical energy to be released at an almost constant rate. This effect is especially great when the character rings are selected at the moment at the release of energy. A similar effect of constant rate of energy release also occurs when a mechanical governor is substituted for motor 5.

The instant invention suggests a number of alternative methods for returning character rings 12 and pawls 18 to their preselection state. For example, pawls 18 could be returned by a separate returning member and character rings 12 could be aligned by the frictional load of inking roller 26, which would cause spring member 14 to reengage with groove 13 after printing has been completed. Furthermore, a number of alternative printing methods could be accommodated in the present construction. For example, a platen may be used instead of print hammer 20. Also, a roller type platen or flying hammers energized by a rotating body could be used to strike the characters. It is preferred that when inking roller 26 is a single unit, that it be disengaged from character rings 12 during the process of selection so that no frictional load is applied thereto. However, it is also possible to utilize a construction in which inking roller 26 and character rings 12 are always in contact. This may be accomplished by adjusting the torque of shaft 11, the force of spring members 14 and using an inking roller 26 of soft material that has small contact resistance. In addition, other known energy storage arrangements may be used in place of coil spring 7. Thus it is seen that the miniature printer in accordance with the instant invention stores the energy from manual operation or motor power in a storage means and the selection printing paper feeding process are carried out with the stored energy. Accordingly, the objects of simplified construction, small size, lightweight, and energy efficiency are readily obtained.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A miniature printer for printing a web of paper comprising energy storage means, means for supplying energy to said energy storage means, said energy supplying means being displaceable in a first direction to effect energy storage and being displaceable in a second direction opposite from said first direction during release of the energy stored in said energy storage means, paper feeding means, a plurality of rotatable character rings having a plurality of characters disposed about their periphery, means for selecting a single said character on each of said character rings for printing on said paper, means operatively coupling said energy supplying means and said character selection means for at least in part powering said character selection means during the supply of energy to said energy storage means to effect character selection, means for effecting printing of said characters on said paper and means operatively coupling said energy storage means with said paper feeding means and said printing means to power said paper feeding means and printing means by the energy released from printing means when said energy supplying means is displaced in said second direction but not when said energy supplying means is displaced in said first direction.

2. A miniature printer as claimed in claim 1, wherein said energy storage means comprises spring means tensioned by said means for supplying energy to said energy storage means.

3. A miniature printer as claimed in claim 1, wherein said character selection means includes a plurality of multi-toothed ratchet wheels corresponding to the number of said character rings, each said ratchet wheel being coupled for rotation with an associated character ring, a plurality of pawl means corresponding to the number of said ratchet wheels, each said pawl means being reciprocable from a first position out of engagement with said ratchet wheel to a second position in engagement with a tooth of said ratchet wheel associated with a selected character to lock the position of said character rings at a selected position, and means for selectively reciprocating said pawl means.

4. A miniature printer as claimed in claim 3, wherein said pawl reciprocating means comprises means biasing said pawl means to its second position, a displaceable stop member cooperating with said pawl means to hold said pawl means in its first position and electromagnetic means for selectively displacing said stop member to release said pawl means for character selection.

5. A miniature printer as claimed in claim 4, said means operatively coupling said energy supplying means and energy storage means including a rotating shaft, said character rings being mounted on said rotating shaft, said character rings each including clutch means for allowing said character rings to rotate with said shaft when said pawl means are in said first position, said clutch means permitting said shaft to rotate when a pawl means is in its second position and the associated character ring is stopped thereby.

6. A miniature printer as claimed in claim 5, wherein said shaft mounting said character rings is coupled to said energy storage means and is driven in a first rotary direction during the supply of energy into said energy storage means and is driven in a second rotary direction during said release of said energy from said energy storage means, said clutch means rotating said character rings in said first direction to position characters for printing and rotating said character rings in said second direction for returning said character rings to an initial position.

7. A miniature printer as claimed in claim 6, wherein said means reciprocating said pawl means includes means for returning said pawl means to their first positions during rotation of said shaft mounting said character rings in its second position.

8. A miniature printer as claimed in claim 1, wherein said printing means comprises a print hammer reciprocable from a first position out of engagement with said character rings and said paper to a second position in engagement with said character rings and said paper and means for reciprocating said print hammer in response to the energy released from said energy storage means.

9. A miniature printer as claimed in claim 8, wherein said print hammer reciprocating means comprise cam means, said means coupling said energy storage means and said printing means including unidirectional drive means for driving said cam means during said energy release from said energy storage means, said cam means not being driven during said supplying of energy to said energy storage means.

10. A miniature printer as claimed in claim 1, wherein said paper feeding means comprise a paper feeding roller, and an idler roller, said paper being driven between said paper feeding roller and said idler roller and means for rotating said paper feeding roller operatively coupled to said unidirectional drive means.

11. A miniature printer as claimed in claim 1, further including inking roller means, said inking roller means containing a supply of ink for transfer to said character carred by said character ring.

12. A miniature printer as claimed in claim 11, wherein said inking roller means is reciprocable from a first position out of engagement with said characters on said character ring to a second position in engagement with said characters on said character rings, means for reciprocating said inking roller means, and means operatively coupling said energy storage means and said inking roller reciprocating means for powering the displacement of said inking roller means in response to said stored energy.

13. A miniature printer as claimed in claim 1, wherein said energy supplying means comprise a manually displaceable input means.

14. A miniature printer as claimed in claim 13, wherein said manually displaceable input means includes a manually displaceable member mounted for reciprocal linear displacement in said first and second directions and formed with a rack gear portion, and rotatable gear means for cooperation with said rack gear portion.

15. A miniature printer as claimed in claim 1, wherein said energy supply means comprise electric motor means.

16. A miniature printer as claimed in claim 1, wherein said energy supply means includes an electric motor means and an output member displaced in said first direction by said motor means during energy storage, and displaced in said second direction by release of said stored energy to drive said motor, said output member being operatively coupled to said energy storage means.

17. A miniature printer as claimed in claim 16, including means for regulating the rate of energy released by said energy storage means to maintain such rate substantially constant.

18. A miniature printer as claimed in claim 17, wherein said regulating means is said electrical motor means, said electrical motor means being adapted to generate a back-electromotive force during rotation of said output member in said second direction to effect such regulation.

19. A miniature printer as claimed in claim 1, whereby said energy storage means includes a spring means, a wheel means rotatably driven by said energy supply means and a member secured on one end to said wheel means and at another end to said spring means and adapted for wrapping around said wheel means during energy storage to tension said spring means and to rotate said wheel means during release of stored energy.

* * * * *